US009607798B2

(12) United States Patent
Onoda et al.

(10) Patent No.: US 9,607,798 B2
(45) Date of Patent: Mar. 28, 2017

(54) FUSE UNIT

(71) Applicant: YAZAKI CORPORATION, Tokyo (JP)

(72) Inventors: Shinya Onoda, Makinohara (JP); Yoshinori Ishikawa, Makinohara (JP)

(73) Assignee: YAZAKI CORPORATION, Tokyo (JP)

( * ) Notice: Subject to any disclaimer, the term of this patent is extended or adjusted under 35 U.S.C. 154(b) by 121 days.

(21) Appl. No.: 13/751,177

(22) Filed: Jan. 28, 2013

(65) Prior Publication Data

US 2013/0181806 A1 Jul. 18, 2013

Related U.S. Application Data

(63) Continuation of application No. PCT/JP2011/004303, filed on Jul. 28, 2011.

(30) Foreign Application Priority Data

Jul. 29, 2010 (JP) ..... 2010-170266

(51) Int. Cl.
*H01H 85/00* (2006.01)
*H01H 69/02* (2006.01)
(Continued)

(52) U.S. Cl.
CPC ..... *H01H 85/0013* (2013.01); *H01H 69/02* (2013.01); *H01H 85/175* (2013.01);
(Continued)

(58) Field of Classification Search
CPC ..... H01H 85/044; H01H 85/12; H01H 85/20; H01H 85/2045; H01H 2085/0034;
(Continued)

(56) References Cited

U.S. PATENT DOCUMENTS 5,167,545 A * 12/1992 O'Brien et al. ..... 439/874
6,806,421 B2 * 10/2004 Matsumura ..... 174/50
(Continued)

FOREIGN PATENT DOCUMENTS

CN 101004989 A 7/2007
JP 2001-093399 A 4/2001
(Continued)

OTHER PUBLICATIONS

Machine Translation of WO 2012133459 A1.*
(Continued)

*Primary Examiner* — Anatoly Vortman
*Assistant Examiner* — Jacob Crum
(74) *Attorney, Agent, or Firm* — Mots Law, PLLC

(57) ABSTRACT

A fuse unit includes: a bus bar including a plurality of fusible parts interposed between a power supply side terminal and a plurality of load side terminals; and an insulating resin portion formed by insert molding using the bus bar as an insert component. The insulating resin portion includes: first and second resin portions respectively arranged at peripheries on the sides of the power supply side terminal and the load side terminals with respect to the fusible parts; and a plurality of coupling portions coupling the first resin portion and the second resin portion in a position outside each of the fusible parts. Each of the coupling portions is formed such that a reinforcement portion having a lower heat shrinkage rate than the insulating resin portion and having a higher strength than the insulating resin portion is an insert component. The reinforcement portion is provided using the bus bar.

7 Claims, 13 Drawing Sheets

(51) Int. Cl.

| | |
|---|---|
| ***H01H 85/175*** | (2006.01) |
| *H01H 85/20* | (2006.01) |
| *H01H 85/02* | (2006.01) |
| *H01H 85/055* | (2006.01) |

(52) U.S. Cl.
CPC ..... *H01H 85/20* (2013.01); *H01H 2085/0034* (2013.01); *H01H 2085/025* (2013.01); *H01H 2085/0555* (2013.01); *H01H 2085/208* (2013.01)

(58) Field of Classification Search
CPC ..... H01H 2085/025; H01H 2085/0555; H01H 85/0013; H01H 85/175; H01H 69/02; H01H 2085/2075; H01H 2085/208
USPC ..... 174/68.2; 337/142, 144, 161, 189, 191; 361/624, 637; 439/366, 620.27, 890
See application file for complete search history.

(56) References Cited

U.S. PATENT DOCUMENTS

| | | | | |
|---|---|---|---|---|
| 7,663,465 | B2 * | 2/2010 | Matsumoto et al. | 337/187 |
| 7,990,738 | B2 * | 8/2011 | Urrea et al. | 361/833 |
| 2001/0011939 | A1 | 8/2001 | Inaba et al. | |
| 2002/0058441 | A1 * | 5/2002 | Sumida et al. | 439/622 |
| 2012/0293295 | A1 * | 11/2012 | Kibushi et al. | 337/142 |
| 2013/0126204 | A1 * | 5/2013 | Nohara | 174/50 |

FOREIGN PATENT DOCUMENTS

| | | | |
|---|---|---|---|
| JP | 2001-297683 | A | 10/2001 |
| JP | 2007-059255 | A | 3/2007 |
| JP | 2010-073516 | A | 4/2010 |
| JP | 2010-092728 | A | 4/2010 |
| JP | 2010140805 | A | 6/2010 |
| WO | WO 2012133459 | A1 * | 10/2012 |

OTHER PUBLICATIONS

The Japanese official action issued on Jun. 3, 2014 in the counterpart Japan patent application. (Partial English translation also submitted.).
Chinese office action letter issued on Aug. 7, 2014.
The Chinese office action letter issued on Apr. 3, 2015 in the counterpart Chinese patent application.
The German office action letter issued on Aug. 6, 2015 in the counterpart German patent application.

* cited by examiner

FUSE UNIT

CROSS REFERENCE TO RELATED APPLICATION

This is a continuation application based on PCT application No. PCT/JP2011/004303 filed on Jul. 28, 2011, which claims the benefit of priority from Japanese Patent Application No. 2010-170266 filed on Jul. 29, 2010, the entire contents of which are incorporated by reference herein.

TECHNICAL FIELD

The present invention relates to a fuse unit in which an insulating resin portion is formed by inset molding at the periphery of a bus bar having a fusible part.

BACKGROUND ART

In recent years, as the number of electrical components has been increased, various fuse units that are mounted on automobiles and have a large number of fusible parts have been proposed (see PTL 1 and PTL 2). One example of the conventional fuse units is shown in FIGS. 1 to 3D.

In FIG. 1, a fuse unit 50 includes: a bus bar 51 that is formed with a conductive metal plate; and an insulating resin portion 60 that is appropriately arranged at the periphery of the bus bar 51. As shown in detail in FIG. 2, the bus bar 51 includes: a conductive plate portion 53 having a power supply side terminal 52; a plurality of load side terminals 54; and a plurality of fusible parts 55 that is interposed between the conductive plate portion 53 and each of the load side terminals 54. Some of the load side terminals 54 have fixing bolts 56 that are fixed by the insulating resin portion 60. Each of the fusible parts 55 has a smaller width than each of the load side terminals 54, and is bent in a crank shape. The width dimension of each of the fusible parts 55 is set based on the individual rated current and voltage values.

As shown in FIG. 1, the insulating resin portion 60 includes: a first resin portion 61 that is arranged at the periphery of the conductive plate portion 53 including the power supply side terminal 52; a second resin portion 62 that is arranged at the periphery of the load side terminals 54; and a plurality of coupling portions 63 that couples the first resin portion 61 and the second resin portion 62 in positions outside the fusible parts 55.

A window portion 64 through which the fusible part 55 is exposed is provided by each of the coupling portions 63. Thus, it is possible to visually check whether or not the fusible part 55 is melted down.

PTL 2 discloses a fuse unit having the same configuration as the conventional example.

CITATION LIST

Patent Literature

PTL1: Japanese Unexamined Patent Application Publication No. 2007-59255

PTL2: Japanese Unexamined Patent Application Publication No. 2001-297683

SUMMARY OF INVENTION

Technical Problem

However, since, in the conventional fuse unit 50, the insulating resin portion 60 is formed by insert molding, a stress resulting from heat shrinkage produced after the resin molding acts on the bus bar 51. In particular, as shown in FIGS. 3A to 3C, each of the coupling portions 63 is formed of only resin material, it significantly deforms as indicated by imaginary lines in FIG. 3D. Hence, great stress concentration is produced in the fusible part 55, which is arranged in the vicinity of the coupling portion 63 and which is lower in mechanical strength than the other portions, especially in the narrowest part of the fusible part 55 that has the narrowest width. When the stress concentration is produced in the fusible part 55 (especially, the narrowest part), the fusing property is likely to vary. Since the narrowest part of the fusible part 55 is needed to quickly blow in the fusing property, the narrowest part cannot be formed so as to have a wider width.

As shown in FIGS. 3A to 3C, each of the coupling portions 63 is formed of resin material, and therefore its mechanical strength is disadvantageously low. Hence, when the mating terminal (not shown) is fastened to the load side terminal 54 having the fixing bolt 56, the fastening force may damage the coupling portion 63. Here, it can be considered that its thickness dimension is increased to increase the strength of the coupling portion 63. However, when the thickness dimension of the coupling portion 63 is increased, the amount of resin shrinkage produced after the resin molding is increased, and the stress concentration of the fusible parts 55 is also increased. It is therefore impossible to increase the thickness of the coupling portion 63.

The present invention has been made to solve the foregoing problem; an object of the present invention is to provide a fuse unit that minimizes stress concentration of a fusible part resulting from heat shrinkage produced after resin molding and that also enhances the mechanical strength of a coupling portion.

Solution to Problem

According to the present invention, there is provided a fuse unit including: a bus bar that includes a plurality of fusible parts interposed between a power supply side terminal and each of a plurality of load side terminals; and an insulating resin portion that is formed by insert molding using the bus bar as an insert component, in which the insulating resin portion includes: a first resin portion that is arranged at a periphery on the side of the power supply side terminal with respect to the fusible parts; a second resin portion that is arranged at a periphery on the side of the load side terminals with respect to the fusible parts; and a plurality of coupling portions that couples the first resin portion and the second resin portion in a position outside each of the fusible parts, and each of the coupling portions is formed such that a reinforcement portion having a lower heat shrinkage rate than the insulating resin portion and having a higher strength than the insulating resin portion is an insert component.

The reinforcement portion is preferably provided in the bus bar. The reinforcement portion preferably has the same width as the coupling portion.

Advantageous Effects of Invention

According to the present invention, since the coupling portions are formed with the reinforcement portions that are made of a low heat shrinkage material and the resin material, the amount of heat shrinkage produced after the resin molding in the coupling portions is reduced. Moreover, since the coupling portions are formed with the reinforcement portions having a high mechanical strength and the resin material, as compared with the case where only the resin material is used, the mechanical strength is increased. Consequently, the stress concentration of the fusible parts resulting from the heat shrinkage produced after the resin molding is minimized, and the mechanical strength of the coupling portions is also enhanced.

DESCRIPTION OF EMBODIMENTS

An embodiment of the present invention will be described below with reference to accompanying drawings.

Embodiment

Figure 4:
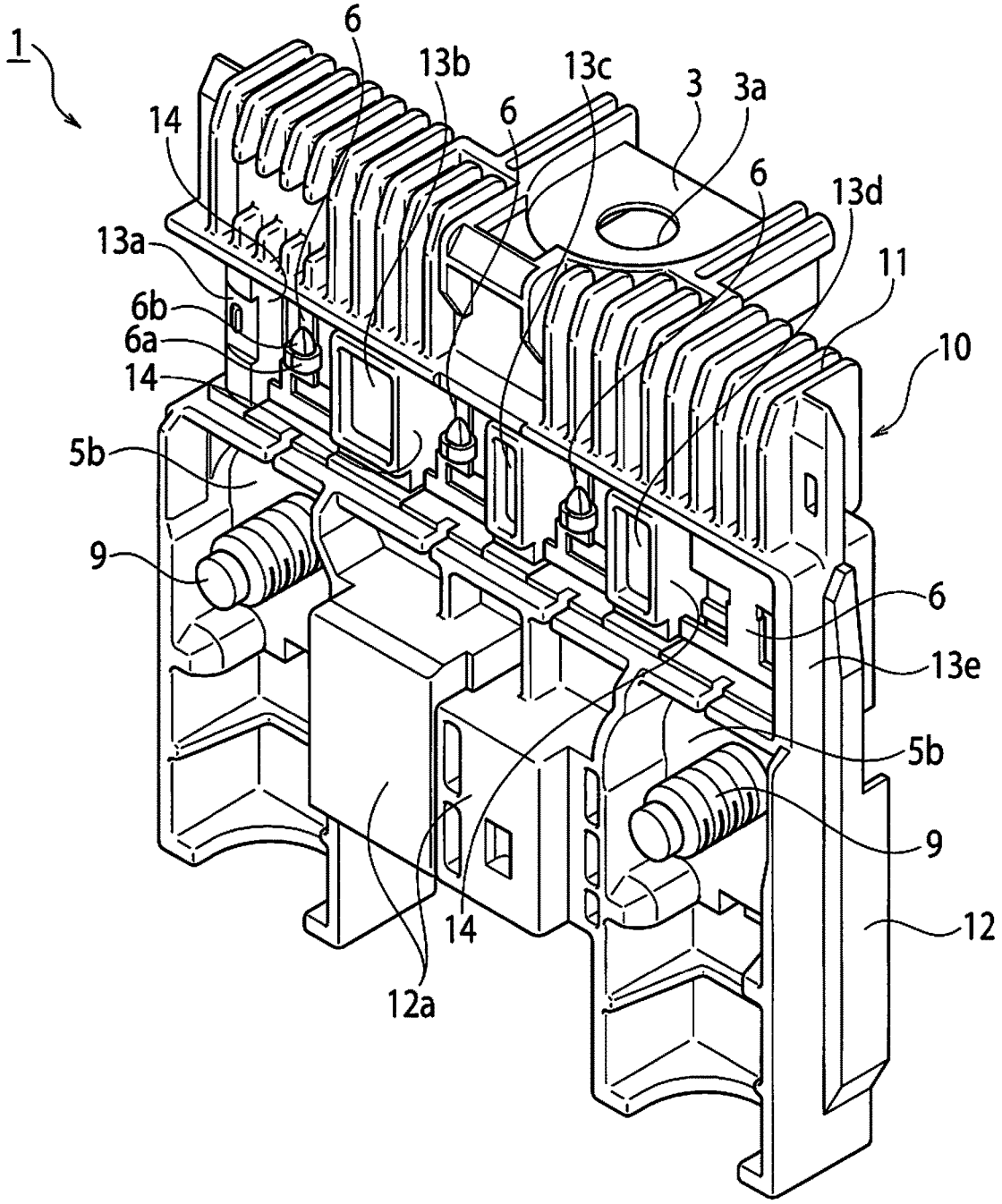
FIG. 4 is a perspective view of a fuse unit according to an embodiment of the present invention.
Figure 5:
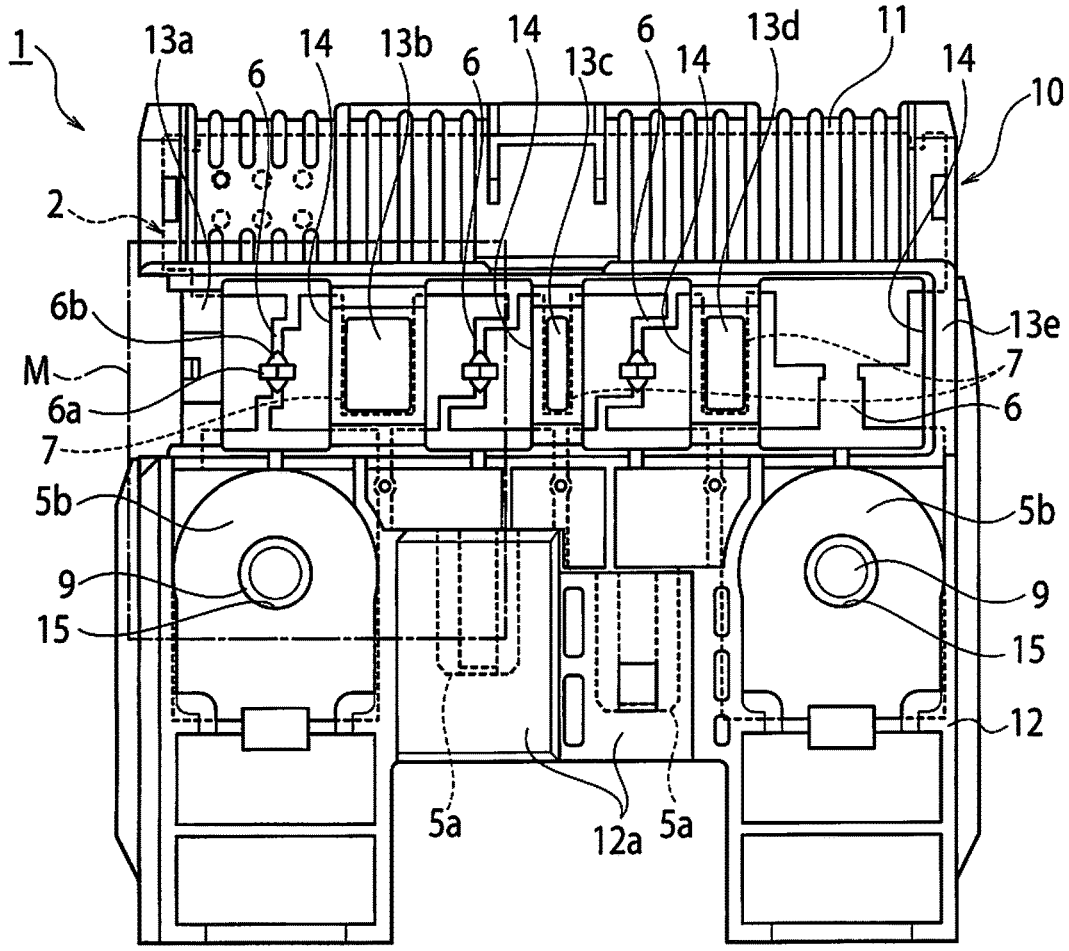
FIG. 5 is a front view of a fuse unit according to the embodiment of the present invention.

FIGS. 4 to 9D show an embodiment of the present invention. As shown in FIGS. 4 and 5, a fuse unit 1 is designed to be mounted on a vehicle, and is directly attached to a so-called battery (not shown). The fuse unit 1 includes: a bus bar 2 that is formed with a conductive metal plate; and an insulating resin portion 10 that is arranged so as to cover an appropriate area on the periphery of the bus bar 2.

Figure 6:
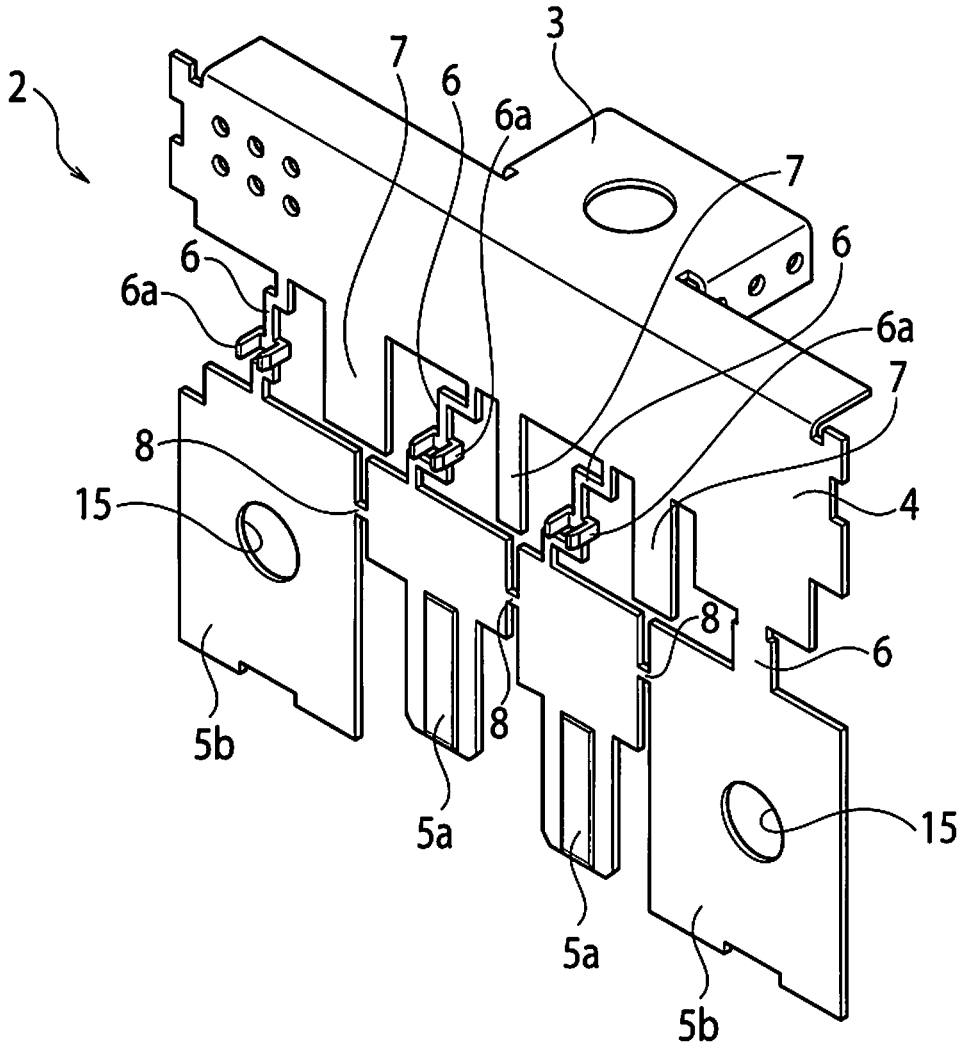
FIG. 6 is a perspective view of a bus bar according to the embodiment of the present invention.
Figure 7:
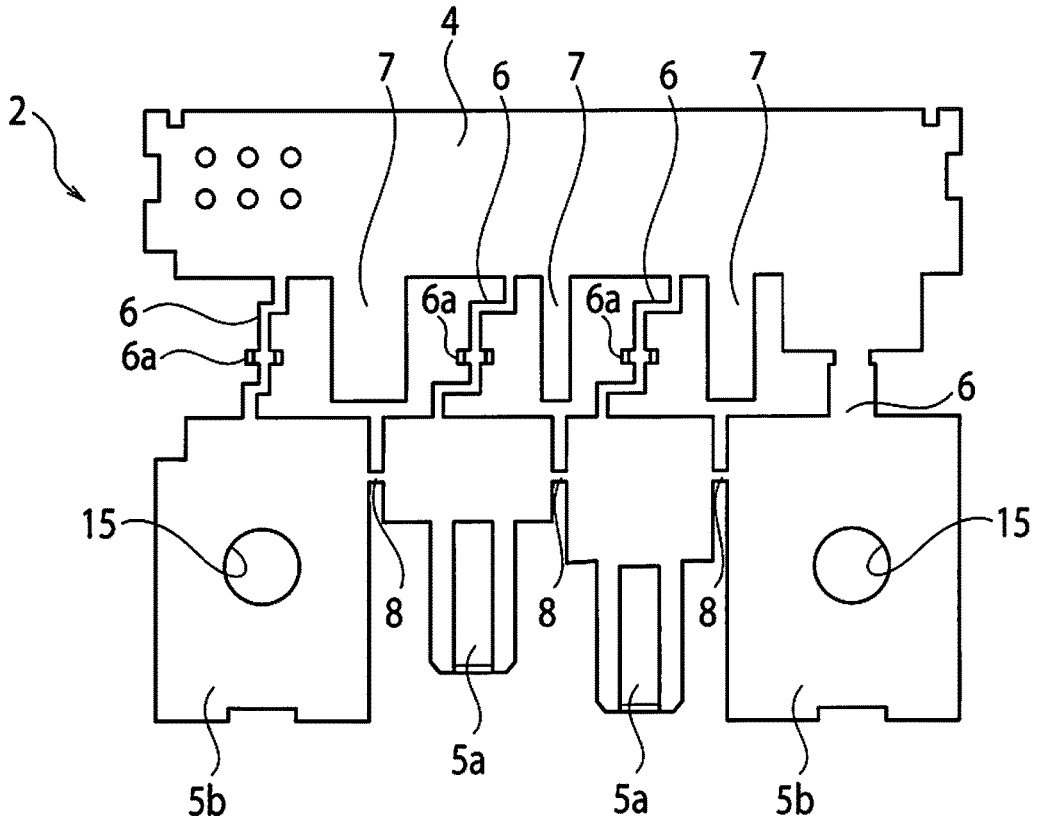
FIG. 7 is a front view of the bus bar according to the embodiment of the present invention.

As shown in detail in FIGS. 6 and 7, the bus bar 2 is formed by bending the conductive metal plate having a predetermined shape. The bus bar 2 includes: a conductive plate portion 4 having a power supply side terminal 3; a plurality of load side terminals 5*a* and 5*b*; a plurality of fusible parts 6 that is interposed between the conductive plate portion 4 and each of the load side terminals 5*a* and 5*b*; and a plurality of reinforcement portions 7 that is arranged between the adjacent fusible parts 6. FIGS. 6 and 7 show the form of the bus bar 2 before insert molding; the adjacent load side terminals 5*a* and 5*b* are coupled by joint portions 8.

The power supply side terminal 3 has a bolt insertion hole 3*a*. A battery post and the mating terminal (not shown) such as a battery connection terminal are connected to the power supply side terminal 3 using the bolt insertion hole 3*a* by fastening with a bolt and a nut.

The conductive plate portion 4 is bent substantially at a right angle in the intermediate position. Thus, the fuse unit 1 is arranged along both the upper surface and the side surface of the battery (not shown).

The load side terminals 5*a* and 5*b* are arranged a distance apart from each other side by side. The two in the center position of the load side terminals 5*a* and 5*b* have the form of a tab terminal; the two on both outsides have the form of a fastening terminal. In each of the load side terminals 5*a* having the form of a tab terminal, a connector housing portion 12*a* is provided by insert-molding the insulating resin portion 10. The mating terminal (not shown) on the load side is connected with a connector to each of the load side terminals 5*a* having the form of a tab terminal. The load side terminals 5*b* having the form of a fastening terminal have bolt insertion holes 15. In the load side terminals 5*b* having the form of a fastening terminal, fixing bolts 9 are provided by insert-molding the insulating resin portion 10 using the bolt insertion holes 15. The mating terminals (not shown) on the load side are connected to the load side terminals 5*b* by fastening nuts.

Figure 8:
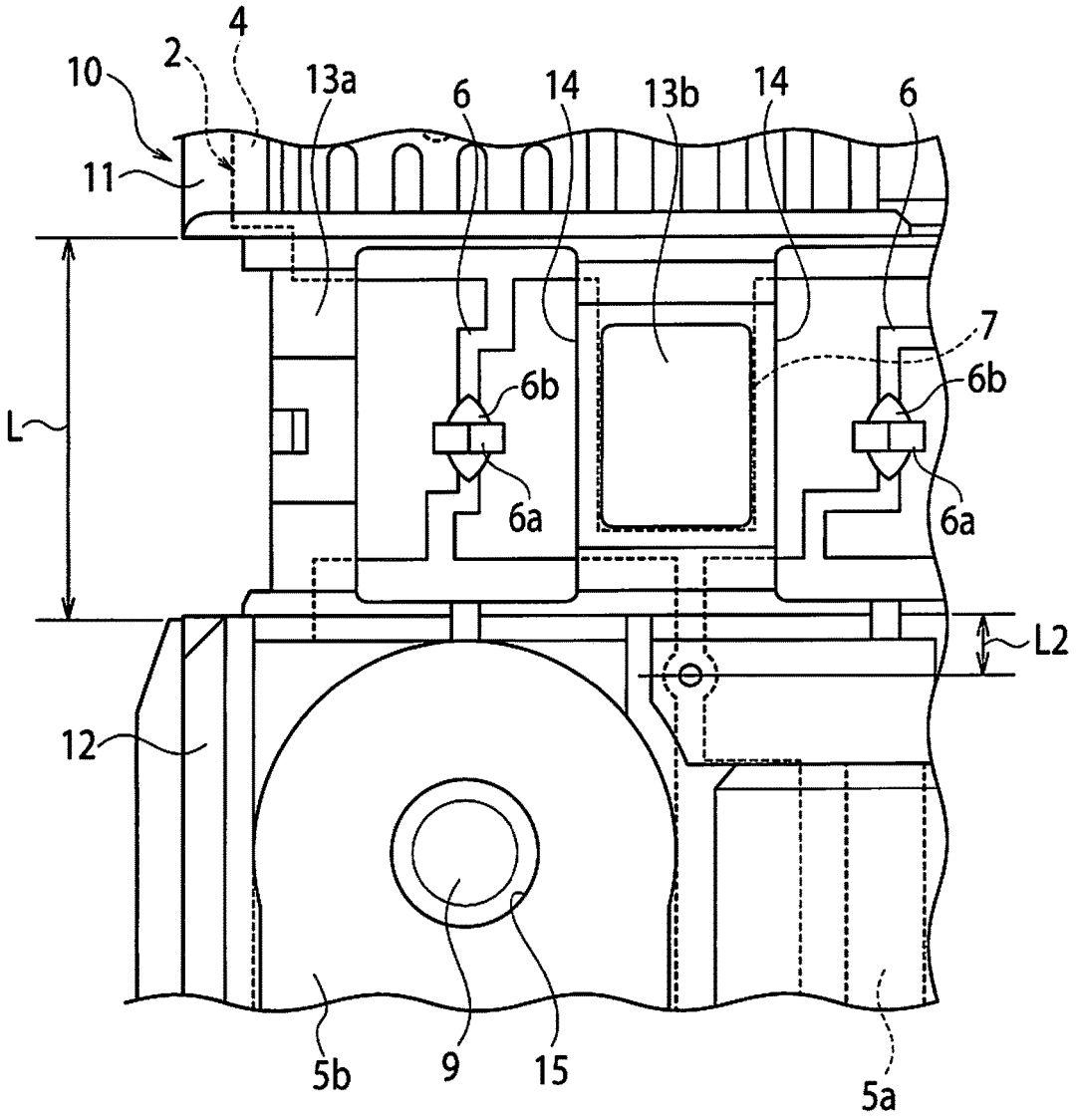
FIG. 8 is an enlarged view of a portion M of FIG. 5.
Figure 9A:
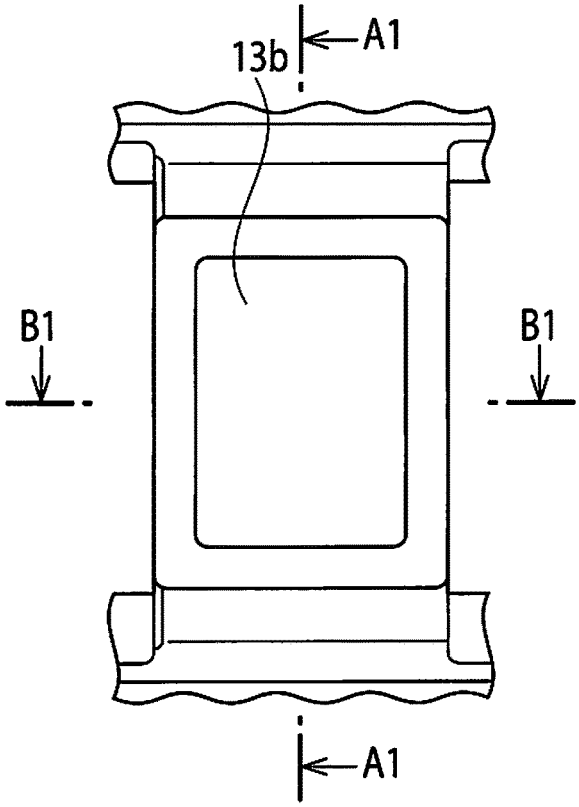
FIG. 9A is a front view of a coupling portion according to the embodiment of the present invention.
Figure 9B:
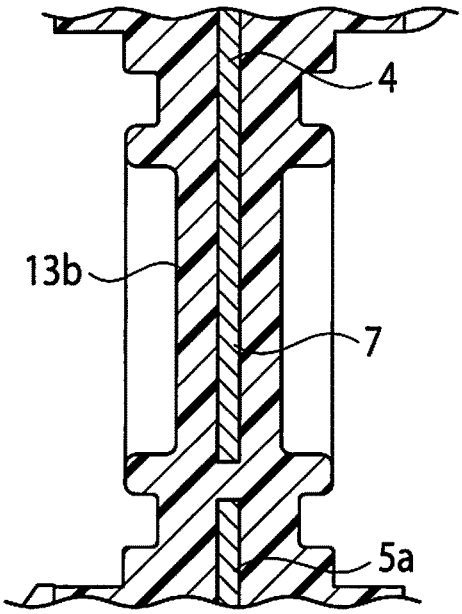
FIG. 9B is a cross-sectional view taken along line A1-A1 of FIG. 9A.
Figure 9C:
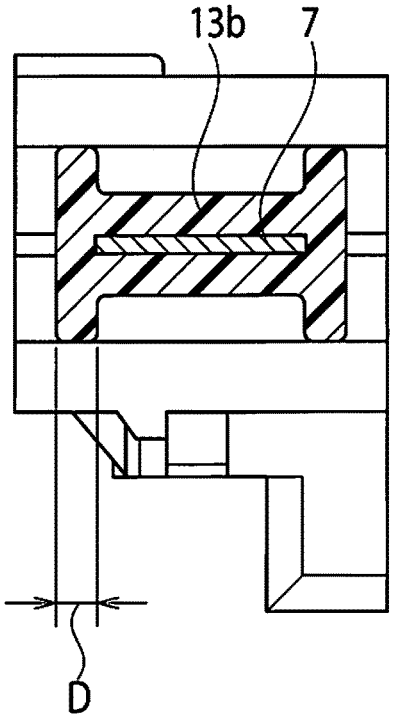
FIG. 9C is a cross-sectional view taken along line B1-B1 of FIG. 9A.
Figure 9D:
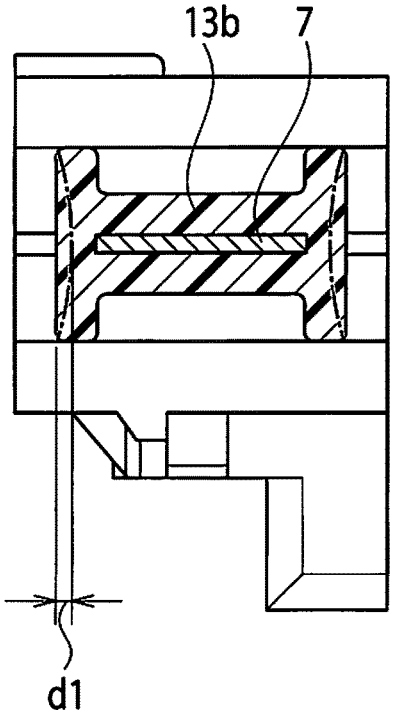
FIG. 9D is a cross-sectional view illustrating a shrinkage state of the coupling portion according to the embodiment of the present invention after resin molding.

As shown in detail in FIGS. 8 and 9D, each of the reinforcement portions 7 is provided to extend from the conductive plate portion 4 toward the load side terminals 5*a* and 5*b*. The reinforcement portions 7 are not coupled to the load side terminals 5*a* and 5*b*. The reinforcement portions 7 are arranged in positions corresponding to coupling portions 13*b* to 13*d* of the insulating resin portion 10, respectively; the reinforcement portions 7 are used as insert components when the insulating resin portion 10 are insert-molded. Each of the reinforcement portions 7 has a lower heat shrinkage rate than the insulating resin portion 10, and has a higher strength than the insulating resin portion 10. The reinforcement portions 7 are set such that they have smaller widths than the coupling portions 13*b* to 13*d*. Thus, the side end surfaces of the reinforcement portions 7 are positioned D (indicated in FIG. 9C) inwardly from the side end surfaces of the coupling portions 13*b* to 13*d*.

The fusible parts 6 are arranged a distance apart from each other side by side. Each of the fusible parts 6 has a smaller width than each of the load side terminals 5*a* and 5*b*, and is bent in a crank shape. The width dimension of each of the fusible parts 6 is set based on the individual rated current and voltage values. The three fusible parts 6 are provided with crimp portions 6*a*. A low-melting point metal (for example, tin) 6*b* is fixed to each of the crimp portions 6*a* by crimping.

As shown in FIGS. 4 and 5, the insulating resin portion 10 includes: a first resin portion 11 that is arranged at the periphery of the conductive plate portion 4 including the power supply side terminal 3; a second resin portion 12 that is arranged at the periphery of the load side terminals 5*a* and 5*b*; and a plurality of coupling portions 13*a* to 13*e* that couples the first resin portion 11 and the second resin portion 12 in positions outside the fusible parts 6.

In the second resin portion 12, a connector housing portion 12*a* is provided around the load side terminals 5*a* having the form of a tab terminal.

A window portion 14 through which each of the fusible parts 6 is exposed is individually provided between the adjacent coupling portions 13*a* to 13*e*. Thus, it is possible to visually check whether or not each of the fusible parts 6 is melted down. As shown in FIGS. 9A to 9D, in the coupling portions 13*b* to 13*d* excluding the both ends thereof, the reinforcement portions 7 of the bus bar 2 are individually incorporated. In other words, the three coupling portions 13*b* to 13*d* have a double structure composed of the reinforcement portion 7 and the resin material.

As shown in detail in FIG. 8, the three coupling portions 13*b* to 13*d* couple an area L between the lower end surface of the first resin portion 11 and the upper end surface of the second resin portion 12. Here, the lower end side of the coupling portions 13*b* to 13*d* is provided such that a dimension L1 from the upper end surface of the second resin portion 12 is a limit and is inserted into the second resin portion 12.

A method of manufacturing the fuse unit 1 will now be described briefly. First, as shown in FIGS. 6 and 7, the bus bar 2 having a predetermined shape is produced by punching a conductive metal material.

Then, the low-melting point metal 6*b* is fixed by crimping to each of the fusible parts 6 of the bus bar 2. Then, each of the joint portions 8 of the bus bar 2 is cut.

Then, the bus bar 2 and the fixing bolts 9 are set within a mold (not shown) for resin molding, and insert molding is performed using the bus bar 2 and the fixing bolts 9 as insert components. Thus, an appropriate area on the outside of the bus bar 2 is covered, and the insulating resin portion 10 having the window portions 14 through which the fusible parts 6 are exposed is formed. In this way, the manufacturing of the fuse unit 1 shown in FIGS. 4 and 5 is completed.

Figure 1:
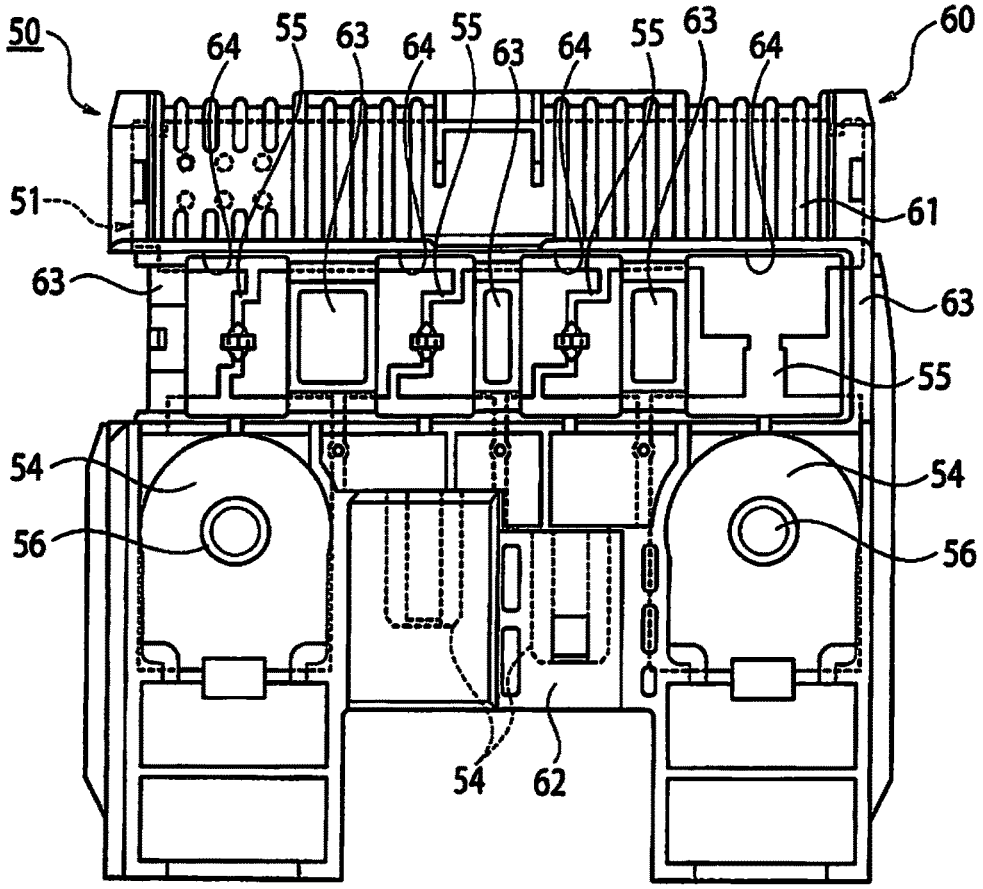
PRIOR ART FIG. 1
FIG. 1 is a front view of a conventional fuse unit.
Figure 2:
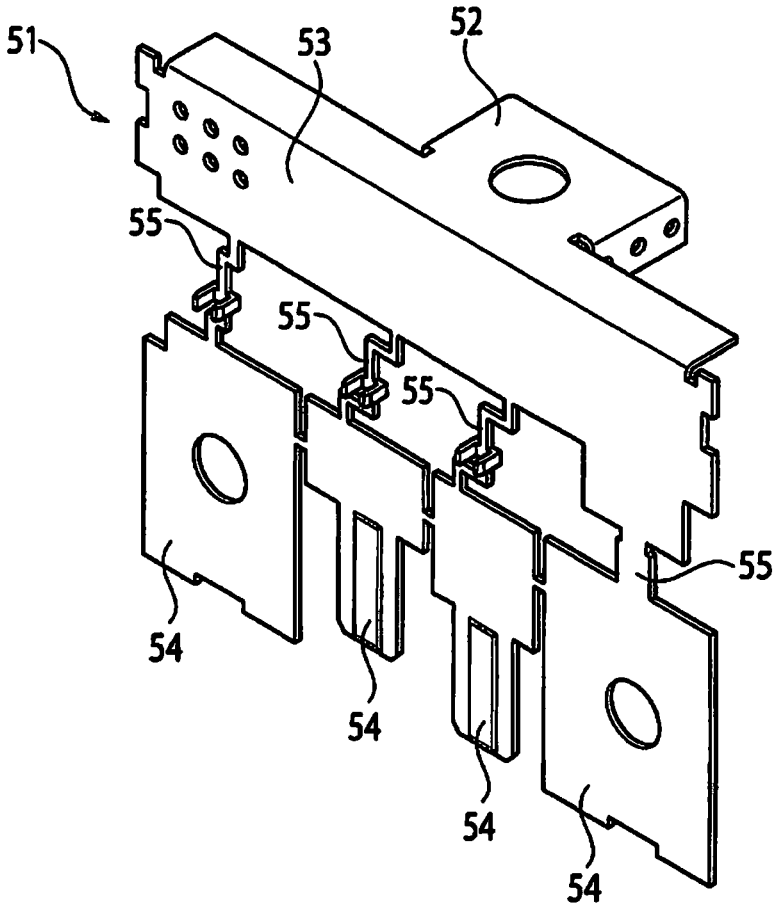
PRIOR ART FIG. 2
FIG. 2 is a perspective view of a conventional bus bar.
Figure 3A:
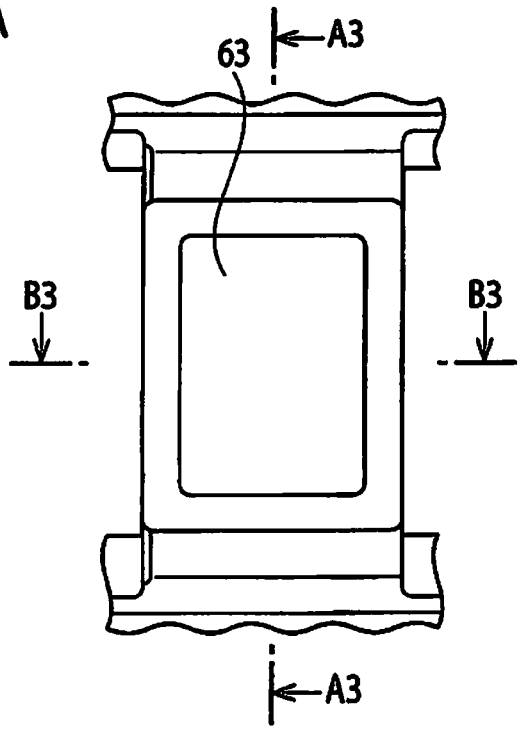
PRIOR ART FIG. 3A
FIG. 3A is a front view of a conventional coupling portion.
Figure 3B:
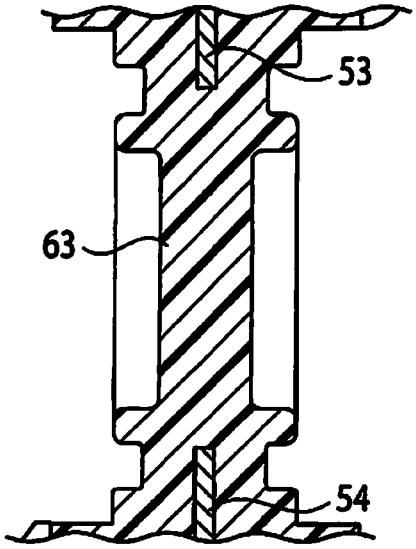
PRIOR ART FIG. 3B
FIG. 3B is a cross-sectional view taken along line A3-A3 of FIG. 3A.
Figure 3C:
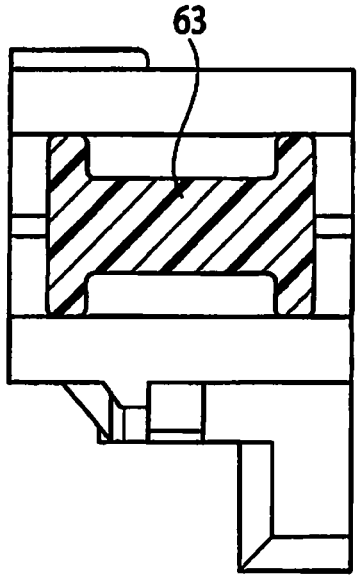
FIG. 3C PRIOR ART
FIG. 3C is a cross-sectional view taken along line B3-B3 of FIG. 3A.
Figure 3D:
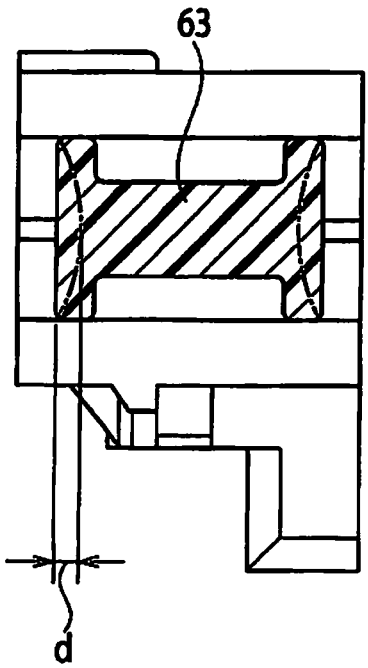
FIG. 3D PRIOR ART
FIG. 3D is a cross-sectional view illustrating a shrinkage state of the conventional coupling portion after resin molding.

As described above, in the fuse unit 1, the coupling portions 13*a* to 13*e* that couple the first resin portion 11 and the second resin portion 12 in positions outside the fusible parts 6 are included, the coupling portions 13*b* to 13*d* have a lower heat shrinkage rate than the insulating resin portion 10 and the reinforcement portions 7 having a higher strength than the insulating resin portion 10 are formed as insert components. As described above, since the coupling portions 13*b* to 13*d* are formed with the reinforcement portions 7 that are made of a low heat shrinkage material and the resin material, the amount of heat shrinkage produced after the resin molding in the coupling portions 13*b* to 13*d* is reduced. Specifically, if the heat shrinkage dimension of the coupling portion in the conventional example is a dimension "d" (shown in FIG. 3D), the heat shrinkage dimension is a dimension "d1" (d1<d, shown in FIG. 9D) that is smaller than the dimension "d". Moreover, since the coupling portions 13*b* to 13*d* are formed with the reinforcement portions 7 having a high mechanical strength and the resin material, as compared with the case where only the resin material is used, the mechanical strength is increased. Consequently, the stress concentration of the fusible parts 6 resulting from the heat shrinkage produced after the resin molding is minimized, and the mechanical strength of the coupling portions 13*b* to 13*d* is also enhanced.

Since the reinforcement portions 7 are provided using the bus bar 2, a special member for the reinforcement portions 7 is not needed, and thus it is possible to decrease the cost.

(Variation)

A variation of the embodiment will now be described. This variation differs in only the configuration of a reinforcement portion 7A from the embodiment. Specifically, although, as shown in FIGS. 10A to 10D, the reinforcement portion 7A is formed with the bus bar 2, its width dimension is set equal to the width of the coupling portion 13*b*. Therefore, the side end surfaces of the reinforcement portion 7A on both sides are flush with the side end surface of the coupling portion 13*b*.

The other configuration is the same as the embodiment, and hence its description will not be repeated. In FIGS. 10A to 10D, for the sake of clarity, the same constituent parts are identified with the same symbols.

As in the embodiment, in the variation, the stress concentration of the fusible parts 6 resulting from the heat shrinkage produced after the resin molding is minimized, and the mechanical strength of the coupling portion 13*b* (not shown) is also enhanced.

Figure 10A:
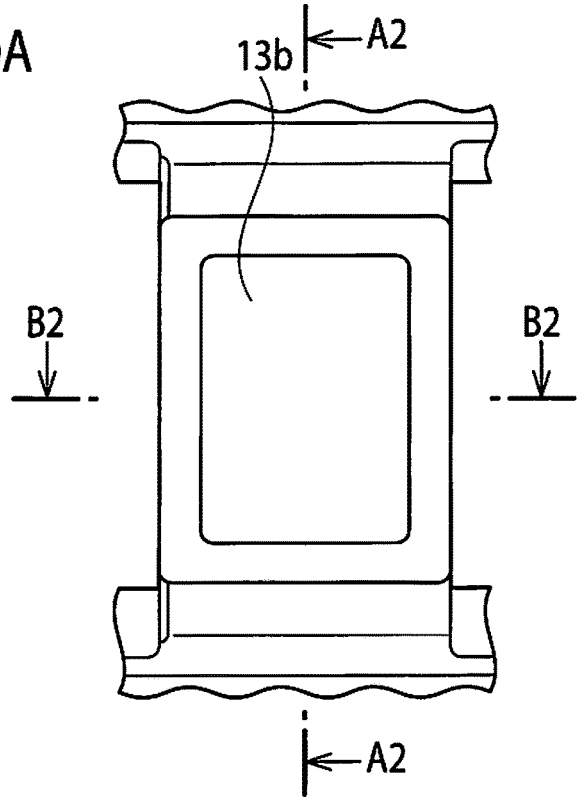
FIG. 10A is a front view of a coupling portion according to a variation of the embodiment of the present invention.
Figure 10B:
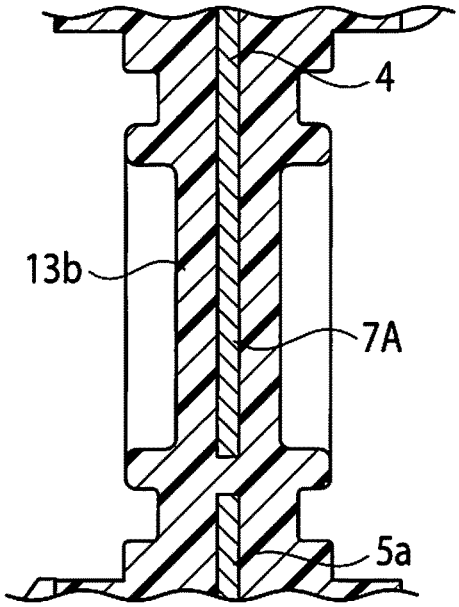
FIG. 10B is a cross-sectional view taken along line A2-A2 of FIG. 10A.
Figure 10C:
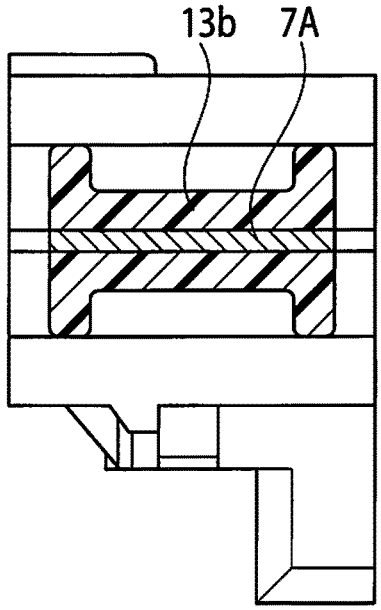
FIG. 10C is a cross-sectional view taken along line B2-B2 of FIG. 10A.
Figure 10D:
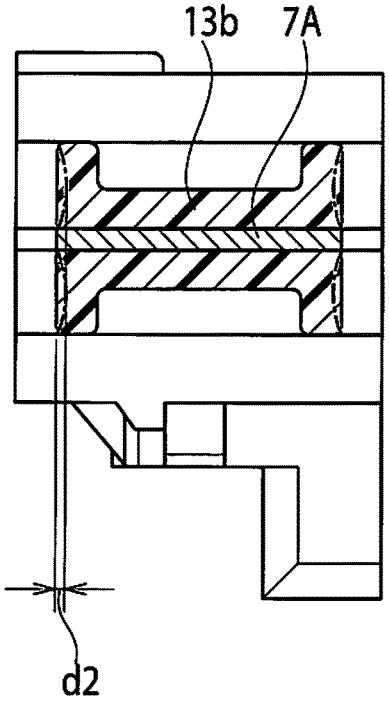
FIG. 10D is a cross-sectional view illustrating a shrinkage state of the coupling portion according to variation of the embodiment of the present invention after resin molding.

Since the reinforcement portion 7A has the same width as the coupling portion 13*b*, as shown in FIG. 10D, the amount of heat shrinkage d2 (d2<d1) produced after the resin molding in the coupling portion 13*b* is lower than that in the embodiment. Thus, it is possible to further reduce the stress concentration of the fusible parts 6 resulting from the heat shrinkage produced after the resin molding.

(Others)

Although, in the embodiment, the reinforcement portions 7 and 7A are provided using the bus bar 2, they may be naturally provided using a member other than the bus bar 2, as long as the member has a lower heat shrinkage rate than the insulating resin portion 10, and has a higher strength than the insulating resin portion.

Although, in the embodiment, the reinforcement portions 7 and 7A are provided only within the coupling portions 13*b* to 13*d*, which are positioned between the adjacent fusible parts 6, they may be provided within the coupling portions 13*a* and 13*e*, which are positioned on both ends.

REFERENCE SIGNS LIST

1: fuse unit
2: bus bar
3: power supply side terminal
5*a* and 5*b*: load side terminal
6: fusible part
7 and 7A: reinforcement portion
10: insulating resin portion
11: first resin portion
12: second resin portion

The invention claimed is:

1. A fuse unit comprising:

a bus bar that includes a plurality of fusible parts extending from a power supply side terminal to a plurality of load side terminals; and an insulating resin portion that is formed by insert molding using the bus bar as an insert component, wherein the insulating resin portion includes: a first resin portion that is arranged at a periphery on a side of the power supply side terminal with respect to the fusible parts; a second resin portion that is arranged at a periphery on a side of the load side terminals with respect to the fusible parts; and a plurality of coupling portions that couple the first resin portion and the second resin portion at positions outside each of the fusible parts, each of the coupling portions is formed such that a reinforcement portion having a lower heat shrinkage rate than the insulating resin portion and having a higher strength than the insulating resin portion is an insert component such that there is a plurality of the reinforcement portions, each of the reinforcement portions is arranged apart from the fusible parts such that each of the fusible parts does not extend via any of the reinforcement portions from the power supply side terminal, the reinforcement portions are arranged along the fusible parts, and the reinforcement portions extend beyond middles of the fusible parts from the power supply side terminal toward the load side terminals.

2. The fuse unit of claim 1, wherein each of the reinforcement portions has the same width as each of the coupling portions, and side end surfaces on both sides of each of the reinforcement portions are flush with side end surfaces on both sides of each of the coupling portions.

3. The fuse unit of claim 1, wherein each of the reinforcement portions overlaps with the load side terminals adjacent each other, viewed from a width direction thereof.

4. The fuse unit of claim 1, wherein the reinforcement portions extend from the power supply side terminal at positions different from positions at which the fusible parts extend from the power supply side terminal [such that each of the fusible parts does not extend from any of the reinforcement portions].

5. The fuse unit according to claim 1, wherein the fusible parts and the reinforcement portions are alternatingly provided.

6. The fuse unit according to claim 1, wherein the reinforcement portions extending from the power supply side terminal toward the load side terminal in a direction has the same length in the extending direction.

7. The fuse unit according to claim 1, wherein a dimension of heat shrinkage of a part of the coupling portion of the insulating resin portion in which the reinforcement portion is provided is smaller than a dimension of heat shrinkage of a part of the coupling portion of the insulating resin portion in which the reinforcement portion is not provided.

* * * * *